US009837018B2

(12) United States Patent
Lee et al.

(10) Patent No.: US 9,837,018 B2
(45) Date of Patent: Dec. 5, 2017

(54) DISPLAY DEVICE COMPENSATING VARIATION OF POWER SUPPLY VOLTAGE

(71) Applicant: SAMSUNG DISPLAY CO., LTD., Yongin, Gyeonggi-Do (KR)

(72) Inventors: Jae-Hoon Lee, Seoul (KR); Jong-Man Bae, Seoul (KR); Byeong-Doo Kang, Cheonan-si (KR); Jin-Woo Kim, Hwaseong-si (KR); Do-Hyung Ryu, Yongin-si (KR); Jae-Woo Song, Anyang-si (KR); Byung-Hyuk Shin, Seoul (KR); Baek-Woon Lee, Yongin-si (KR); Hae-Goo Jung, Seongnam-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 289 days.

(21) Appl. No.: 14/680,453

(22) Filed: Apr. 7, 2015

(65) Prior Publication Data

US 2016/0086542 A1 Mar. 24, 2016

(30) Foreign Application Priority Data

Sep. 24, 2014 (KR) ..... 10-2014-0127452

(51) Int. Cl.
*G09G 3/20* (2006.01)
*G09G 3/3225* (2016.01)

(52) U.S. Cl.
CPC ..... *G09G 3/3225* (2013.01); *G09G 3/2022* (2013.01); *G09G 2300/0426* (2013.01);
(Continued)

(58) Field of Classification Search
CPC ..... G09G 3/3225; G09G 3/2022; G09G 2300/0426; G09G 2320/0223;
(Continued)

(56) References Cited

U.S. PATENT DOCUMENTS 7,148,630 B2 * 12/2006 Koyama ..... G09G 3/3225 257/E27.116
7,414,622 B2 * 8/2008 Abe ..... G09G 3/22 345/204

(Continued)

FOREIGN PATENT DOCUMENTS

KR 10-2011-0019589 A 2/2011
KR 10-2013-0116411 A 10/2013
KR 10-2014-0045257 4/2016

*Primary Examiner* — Julie Anne Watko
(74) *Attorney, Agent, or Firm* — Lee & Morse, P.C.

(57) ABSTRACT

A display panel includes input power supply line coupled to a power supply at one or more edge portions of the display panel, and an output power supply line coupled to the input power supply line at a predetermined portion of the display panel. The input power supply line receives the power supply voltage, and the output power supply line receives the power supply voltage from the input power supply line. The power supply is coupled to the output power supply line at the one or more edge portions of the display panel, and receives the power supply voltage from the output power supply line to adjust a voltage level of the power supply voltage based on the power supply voltage from the output power supply line. The predetermined portion is at a location different from an edge of the display panel.

20 Claims, 11 Drawing Sheets

(52) U.S. Cl.
CPC ..... *G09G 2320/029* (2013.01); *G09G 2320/0223* (2013.01); *G09G 2320/0233* (2013.01); *G09G 2320/0295* (2013.01); *G09G 2330/02* (2013.01); *G09G 2330/025* (2013.01); *G09G 2330/028* (2013.01)

(58) Field of Classification Search
CPC ..... G09G 2320/0233; G09G 2320/029; G09G 2320/0295; G09G 2330/02; G09G 2330/028; G09G 3/3258; G09G 3/3283; G09G 3/3291; G09G 2300/043; G09G 2320/04; G09G 2320/062; G09G 2320/0646; G09G 2330/025; G09G 2330/021
See application file for complete search history.

(56) References Cited

U.S. PATENT DOCUMENTS

| | | | | |
|---|---|---|---|---|
| 2003/0197667 | A1 | 10/2003 | Numao | |
| 2006/0158396 | A1* | 7/2006 | Jo | G09G 3/3283 345/76 |
| 2009/0256827 | A1* | 10/2009 | Tanikame | G09G 3/3233 345/204 |
| 2013/0162622 | A1 | 6/2013 | Ebisuno et al. | |
| 2013/0241808 | A1 | 9/2013 | Kwon et al. | |
| 2016/0163266 | A1* | 6/2016 | Lee | G09G 5/02 345/694 |
| 2016/0260383 | A1* | 9/2016 | Shin | G09G 3/3258 |
| 2016/0300544 | A1* | 10/2016 | Ding | G09G 3/3696 |
| 2016/0343317 | A1* | 11/2016 | Syu | G02F 1/133 |

* cited by examiner

FIG. 5

| ROW | UNIT1 | | | | UNIT2 | | | | UNIT3 | | | | UNIT4 | | | | UNIT5 | | | | UNIT6 | | | |
|---|---|---|---|---|---|---|---|---|---|---|---|---|---|---|---|---|---|---|---|---|---|---|---|---|
| 1 | ① | 1 | 1 | 1 | 1 | 1 | 1 | 1 | 1 | 1 | 1 | 1 | 1 | ② | 2 | 2 | 2 | 2 | 2 | ③ | 3 | 3 | ④ | 4 |
| 2 | 3 | 3 | ④ | 4 | ① | 1 | 1 | 1 | 1 | 1 | 1 | 1 | 1 | 1 | 1 | 1 | 1 | ② | 2 | 2 | 2 | 2 | 2 | ③ |
| 3 | 2 | 2 | 2 | ③ | 3 | 3 | ④ | 4 | ① | 1 | 1 | 1 | 1 | 1 | 1 | 1 | 1 | 1 | 1 | 1 | 1 | ② | 2 | 2 |
| 4 | 1 | ② | 2 | 2 | 2 | 2 | 2 | ③ | 3 | 3 | ④ | 4 | ① | 1 | 1 | 1 | 1 | 1 | 1 | 1 | 1 | 1 | 1 | 1 |
| 5 | 1 | 1 | 1 | 1 | 1 | ② | 1 | 2 | 2 | 2 | 2 | ③ | 3 | 3 | ④ | 4 | ① | 1 | 1 | 1 | 1 | 1 | 1 | 1 |
| 6 | 1 | 1 | 1 | 1 | 1 | 1 | 1 | 1 | 1 | ② | 2 | 2 | 2 | 2 | 2 | ③ | 3 | 3 | ④ | 4 | ① | 1 | 1 | 1 |

DISPLAY DEVICE COMPENSATING VARIATION OF POWER SUPPLY VOLTAGE

CROSS-REFERENCE TO RELATED APPLICATION

Korean Patent Application No. 10-2014-0127452, filed on Sep. 24, 2014, and entitled, "Display Device Compensating Variation of Power Supply Voltage," is incorporated by reference herein in its entirety.

BACKGROUND

1. Field

One or more embodiments described herein relate to a display device which compensates for variation of one or more power supply voltages.

2. Description of the Related Art

A display generates images based on a power supply voltage. The display may be driven in a progressive emission manner or a simultaneous emission manner. When driven in a progressive emission manner, pixels are driven to sequentially emit light on a row-by-row basis. When driven in a simultaneous emission manner, all the pixels are driven to simultaneously emit light.

In operation, the power supply voltage applied to the display panel may vary according to the amount of load for driving the pixels. This variation may produce a variation in the luminance of the display panel. For example, during progressive emission, the pixels emit light at different time points according to rows of the pixels, and the power supply voltage may have a temporal variation in one frame which may deteriorate luminance uniformity.

SUMMARY

In accordance with one embodiment, a display device includes a power supply to generate a power supply voltage; and a display panel including: a plurality of pixels; an input power supply line coupled to the power supply at one or more edge portions of the display panel, the input power supply line to receive the power supply voltage from the power supply; and an output power supply line coupled to the input power supply line at a predetermined portion of the display panel, the output power supply line to receive the power supply voltage from the input power supply line and to input the power supply voltage to the pixels, wherein: the predetermined portion is at a location different from an edge of the display panel, the power supply is coupled to the output power supply line at the one or more edge portions of the display panel, the power supply to receive the power supply voltage from the output power supply line and to adjust a voltage level of the power supply voltage applied to the input power supply line based on the power supply voltage from the output power supply line.

The predetermined portion may be located substantially at a center of the display panel. The display may drive the display panel in a progressive emission manner to cause the pixels to sequentially emit light on a scan line basis, and the power supply may adjust the voltage level of the power supply voltage applied to the input power supply line to compensate temporal variation of the power supply voltage.

The display may drive the display panel with a digital driving method by dividing each frame into a plurality of sub-frames, and the power supply may adjust the voltage level of the power supply voltage applied to the input power supply line to compensate temporal variation of the power supply voltage within each sub-frame.

The power supply may include a power supply voltage generator to generate the power supply voltage based on at least one switching signal; a feedback circuit coupled to the output power supply line at the one or more edge portions of the display panel, the feedback circuit to generate a feedback voltage based on the power supply voltage received from the output power supply line; and a controller to generate the at least one switching signals for input into the power supply voltage generator, and to adjust a duty cycle of the at least one switching signal based on the feedback voltage.

The at least one switching signal may include a pull-up switching signal and a pull-down switching signal, and the power supply voltage generator includes: a pull-up transistor to be selectively turned on based on the pull-up switching signal; a pull-down transistor to be selectively turned on based on to the pull-down switching signal; an inductor having a terminal coupled to the pull-up transistor and the pull-down transistor and another terminal coupled to an output node of the power supply; and a capacitor having a terminal coupled to the output node of the power supply and another terminal coupled to a ground voltage.

The feedback circuit may include a first resistor coupled between an output node of the power supply and a feedback node; a second resistor coupled between the feedback node and a reference voltage; and a third resistor coupled between the feedback node and the output power supply line. The feedback circuit may further include a unit gain buffer coupled between the output power supply line and the third resistor. The feedback circuit may further include a low pass filter coupled between the output power supply line and the unit gain buffer. The feedback circuit may further include a capacitor coupled to an output terminal of the unit gain buffer to stabilize an output voltage of the unit gain buffer.

The feedback circuit may be coupled to a first end of the output power supply line at a first edge portion of the display panel, the feedback circuit to receive a first output power supply voltage from the output power supply voltage at the first edge portion, the feedback circuit may be coupled to the a second end of the output power supply line at a second edge portion of the display panel opposite to the first edge portion, to receive a second output power supply voltage from the output power supply voltage at the second edge portion, and the feedback circuit may generate the feedback voltage based on the first output power supply voltage and the second output power supply voltage.

The feedback circuit may include a first resistor coupled between an output node of the power supply and a feedback node; a second resistor coupled between the feedback node and a reference voltage; and a third resistor having a terminal coupled to the feedback node and another terminal coupled to the first end of the output power supply line and the second end of the output power supply line.

The feedback circuit may further include a first unit gain buffer coupled between the first end of the output power supply line and the third resistor; and a second unit gain buffer coupled between the second end of the output power supply line and the third resistor. The feedback circuit may further include a first low pass filter coupled between the first end of the output power supply line and the first unit gain buffer; and a second low pass filter coupled between the second end of the output power supply line and the second unit gain buffer. The feedback circuit may further include a first capacitor coupled to an output terminal of the first unit gain buffer to stabilize an output voltage of the first unit gain buffer; and a second capacitor coupled to an output terminal of the second unit gain buffer to stabilize an output voltage of the second unit gain buffer.

The power supply may be coupled to a first end of the input power supply line at the first edge portion of the display panel, the power supply to apply the power supply voltage to the input power supply voltage at the first edge portion, and the power supply may be coupled to the a second end of the input power supply line at the second edge portion of the display panel, the power supply to apply the power supply voltage to the input power supply voltage at the second edge portion.

In accordance with another embodiment, a display device includes a power supply to generate a power supply voltage; and a display panel including: a plurality of pixels; an input power supply line coupled to the power supply at one or more edge portions of the display panel and to receive the power supply voltage from the power supply; an output power supply line coupled to the input power supply line at a predetermined portion of the display panel and to receive the power supply voltage from the input power supply line, the output power supply line coupled to the pixels to provide the power supply voltage to the pixels, wherein the predetermined portion is at a location different from an edge of the display panel, and wherein the power supply includes: a power supply voltage generator to generate the power supply voltage in response to at least one switching signal; a feedback circuit coupled to the output power supply line at the one or more edge portions of the display panel, the feedback circuit to generate a feedback voltage based on the power supply voltage from the output power supply line; and a controller to generate the at least one switching signal and to provide the switching signal to the power supply voltage generator, the controller to adjust a duty cycle of the at least one switching signal based on the feedback voltage to adjust a voltage level of the power supply voltage applied to the input power supply line.

The predetermined portion may be located substantially at a center of the display panel. The display panel may drive the display panel in a progressive emission manner to cause the pixels to sequentially emit light on a scan line basis, and the power supply may adjust the voltage level of the power supply voltage applied to the input power supply line to compensate temporal variation of the power supply voltage.

The display panel may drive the display panel in a digital driving method by dividing each frame into a plurality of sub-frames, and the power supply may adjust the voltage level of the power supply voltage applied to the input power supply line to compensate temporal variation of the power supply voltage within each sub-frame.

BRIEF DESCRIPTION OF THE DRAWINGS

Features will become apparent to those of skill in the art by describing in detail exemplary embodiments with reference to the attached drawings in which:

FIG. 5 illustrates a frame for one embodiment of a progressive emission method with simultaneous scan (PESS);

DETAILED DESCRIPTION

Figure 1:
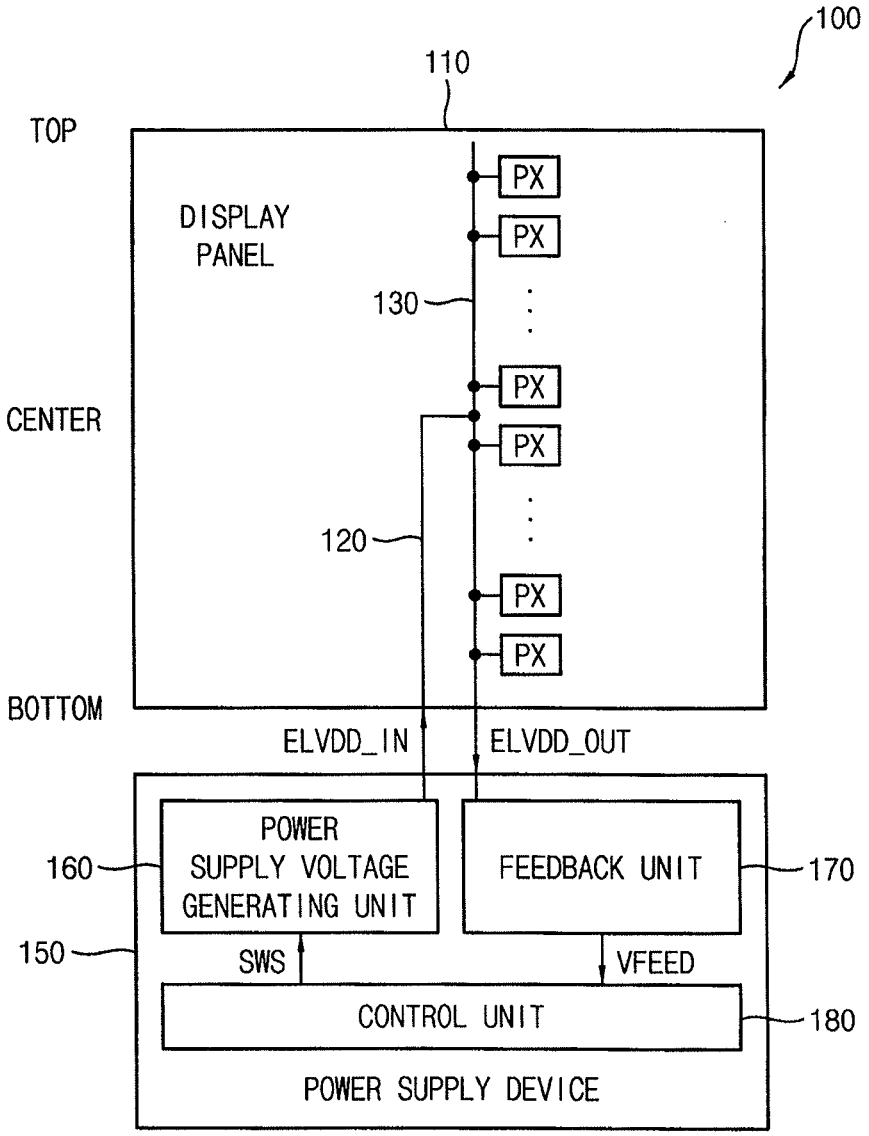
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Referring to FIG. 1, a display device 100 includes a display panel 110 including a plurality of pixels PX and a power supply device 150 that supplies a power supply voltage ELVDD_IN to the display panel 110.

Figure 2:
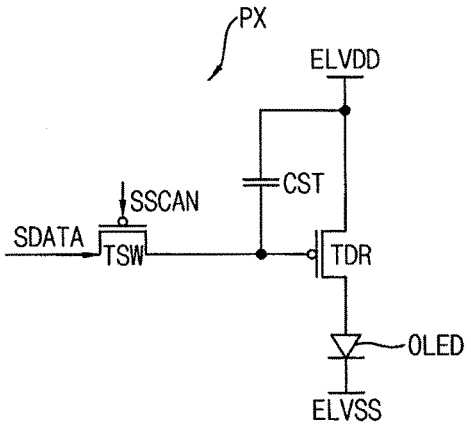
FIG. 2 illustrates an embodiment of a pixel.

The display panel 110 includes a plurality of pixels PX arranged in a matrix having a plurality of rows and a plurality of columns. The display panel 110 may be an organic light emitting display panel, where each pixel PX includes an organic light emitting diode (OLED). For example, as illustrated in FIG. 2, each pixel PX may include a switching transistor TSW, a storage capacitor CST, a driving transistor TDR and the organic light emitting diode OLED.

The switching transistor TSW may transfer a data signal SDATA to the storage capacitor CST in response to a scan signal SSCAN. The storage capacitor CST may store the data signal SDATA transferred by the switching transistor TSW. The driving transistor TDR may from a current path from a high power supply voltage ELVDD to a low power supply voltage ELVSS in response to the data signal SDATA stored in the storage capacitor CST. The organic light emitting diode OLED may emit light based a current flowing from the power supply voltage ELVDD to the low power supply voltage ELVSS. In another embodiment, the display panel 100 may be a different kind of display and/or the pixel PX may have a different configuration.

The display panel 100 may be driven with an analog driving method that produces grayscale values by adjusting an amount of a current flowing through the organic light emitting diode OLED. For example, the data signal SDATA, having a voltage level determined according to a grayscale value, may be applied to the pixel PX. The driving transistor TDR may adjust the amount of the current applied to the organic light emitting diode OLED according to the voltage level of the data signal SDATA.

In another embodiment, the display panel 100 may be driven by a digital driving method that produces grayscale values by adjusting an emission duty cycle of the organic light emitting diode OLED. For example, the emission duty cycle of the organic light emitting diode OLED in a frame may be determined according to a grayscale value, the frame may be divided into a plurality of sub-frames, and the organic light emitting diode OLED may emit light during selected ones of the plurality of sub-frames according to the grayscale value. In this case, the driving transistor TDR may be selectively turned on or off in response to the data signal SDATA to determine whether the organic light emitting diode OLED emit light or does not emit light.

The display panel 110 may further include an input power supply line 120 and an output power supply line 130. The input power supply line 120 receives a power supply voltage ELVDD_IN (e.g., the high power supply voltage ELVDD) from the power supply device 150. The output power supply line 130 receives the power supply voltage ELVDD_IN from the input power supply line 120 and provides the power supply voltage ELVDD to the pixels PX.

The input power supply line 120 may be coupled to the power supply device 150, for example, at one or more edge portions TOP and BOTTOM of the display panel 110 to receive the power supply voltage ELVDD_IN from the power supply device 150. Although FIG. 1 illustrates an example where the input power supply line 120 is coupled to the power supply device 150 at a bottom portion BOTTOM of the display panel 110, in another embodiment the input power supply line 120 may be coupled to the power supply device 150 at one or more of the four edge portions of the display panel 110. For example, the input power supply line 120 may receive the power supply voltage ELVDD_IN from the power supply device 150 at both the top portion TOP and the bottom portion BOTTOM of the display panel 110.

The output power supply line 130 may be coupled to the input power supply line 120 at a predetermined location (e.g., center portion) CENTER of the display panel 110 to receive the power supply voltage ELVDD_IN from the input power supply line 120. Further, the output power supply line 130 may be coupled to the pixels PX to provide the power supply voltage ELVDD to the pixels PX. In other embodiments, the predetermined portion may be a location different from the center not corresponding to an edge.

Because the input power supply line 120 receiving the power supply voltage ELVDD_IN is coupled to the output power supply line 130 at predetermined location (e.g., center portion) CENTER of the display panel 110, and because the output power supply line 130 is coupled to the pixels PX, the power supply voltage ELVDD may be provided in directions from the center portion CENTER to the edge portions TOP and BOTTOM. Accordingly, compared with other types of displays (e.g., ones where a power supply voltage is provided in a direction from an edge portion (e.g., bottom portion BOTTOM) to an opposite edge portion (e.g. top portion TOP)), the difference of the power supply voltages at different locations of the display panel 110 may be reduced in the display device 100. As a result, luminance uniformity of the display panel 110 may be improved.

In this or another embodiment, the high power supply voltage ELVDD may be provided in directions from the predetermined (e.g., center) portion CENTER to both the top and bottom portions TOP and BOTTOM. The low power supply voltage ELVSS may be provided in directions from both the top and bottom portions TOP and BOTTOM to the center portion CENTER. Accordingly, deviation of the difference between the high and low power supply voltages ELVDD and ELVSS according to the location of the display panel 110 may be further reduced. Thus, luminance uniformity of the display panel 110 may be further improved.

Figure 3:
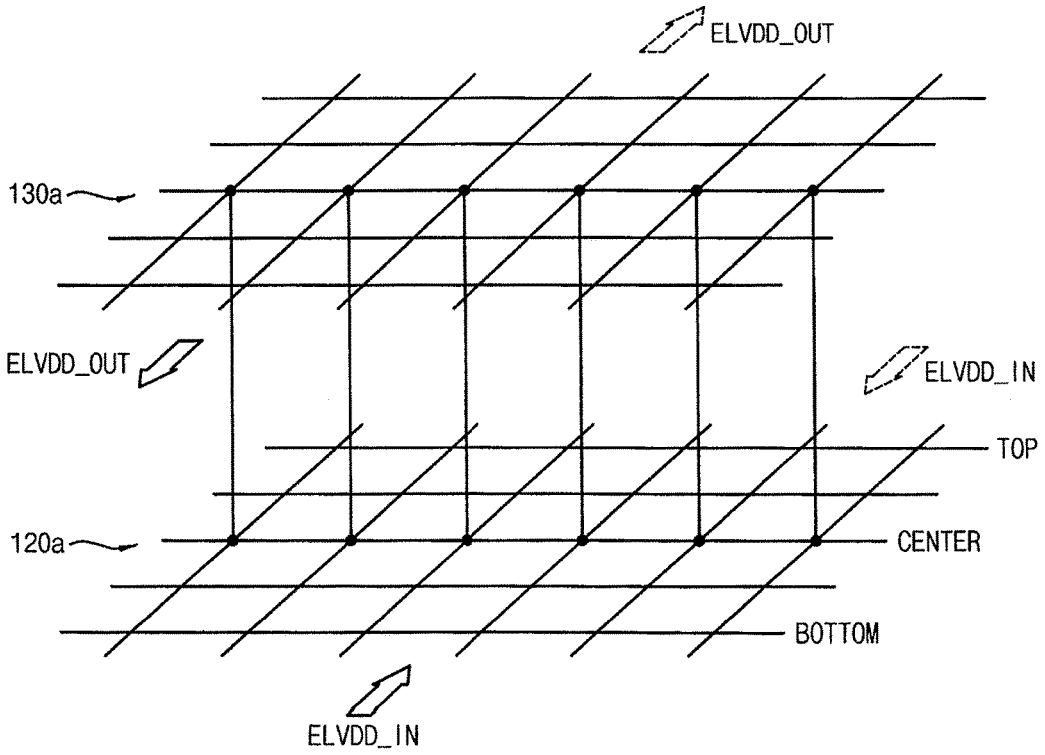
FIG. 3 illustrates an embodiment of input and output power supply lines.

In one embodiment, each of the input power supply line 120 and the output power supply line 130 may have a mesh structure. For example, as illustrated in FIG. 3, each of the input power supply line **120*a* and the output power supply line 130*a* may include at least one line extending in a first direction (e.g., a column direction) and at least one line extending in a second direction (e.g., a row direction) perpendicular to the first direction. The input power supply line 120*a* and the output power supply line 130*a* may be coupled to each other via at least one contact at a predetermined (e.g., center) portion CENTER of the display panel 110. The input power supply line 120*a* may receive the power supply voltage ELVDD_IN from the power supply device 150 at any one or more of the four edge portions of the display panel 110. The output power supply line 130*a* may provide a dropped power supply voltage ELVDD_OUT (e.g., dropped by an IR drop) to the power supply device 150 at one or more of the four edge portions of the display panel 110**.

The power supply device 150 may generate the power supply voltage ELVDD_IN to apply the power supply voltage ELVDD_IN to the display panel 110. In one embodiment, the power supply device 150 may a DC-DC converter that generates the power supply voltage ELVDD_IN applied to the display panel 110 based on a power supply voltage provided from an external device.

Further, the power supply device 150 may receive the power supply voltage ELVDD_OUT that is dropped by a load for driving the pixels PX from the display panel 110, and may adjust a voltage level of the power supply voltage ELVDD_IN applied to the display panel 110 based on the dropped power supply voltage ELVDD_OUT. For example, the power supply device 150 may be coupled to the output power supply line 130 at one or more edge portions TOP and BOTTOM of the display panel 110 to receive the dropped power supply voltage ELVDD_OUT from the output power supply line 130, and may adjust the voltage level of the power supply voltage ELVDD_IN applied to the input power supply line 120 based on the dropped power supply voltage ELVDD_OUT received from the output power supply line 130. Because the power supply voltage ELVDD_OUT dropped by the load for driving the pixels PX are fed back to the power supply device 150, the voltage level of the power supply voltage ELVDD_IN applied to the input power supply line 120 may be adjusted according to the voltage drop of the power supply voltage ELVDD.

Referring to FIG. 1, in one embodiment, the power supply device 150 may include a power supply voltage generating unit 160, a feedback unit 170, and a control unit 180. The power supply voltage generating unit 160 may generate the power supply voltage ELVDD_IN in response to a switching signal SWS received from the control unit 180.

The feedback unit 170 may be coupled to the output power supply line 130 at one or more edge portions (e.g., the bottom portion BOTTOM) of the display panel 100 to receive the dropped power supply voltage ELVDD_OUT from the output power supply line 130, and may generate a feedback voltage VFEED based on the dropped power supply voltage ELVDD_OUT received from the output power supply line 130.

The control unit 180 may provide the switching signal SWS to the power supply voltage generating unit 160 to generate the power supply voltage ELVDD_IN. Further, the control unit 180 may receive the feedback voltage VFEED corresponding to the dropped power supply voltage ELVDD_OUT from the feedback unit 170, and may adjust the voltage level of the power supply voltage ELVDD_IN by adjusting a duty cycle of the switching signal SWS based on the feedback voltage VFEED. For example, the control unit 180 may increase the voltage level of the power supply voltage ELVDD_IN applied to the input power supply line 120 as a voltage level of the power supply voltage ELVDD_OUT received from the output power supply line 130 decreases, and may decrease the voltage level of the power supply voltage ELVDD_IN applied to the input power supply line 120 as the voltage level of the power supply voltage ELVDD_OUT received from the output power supply line 130 increases.

In one embodiment, the display panel 110 may be driven in a progressive emission manner where the pixels PX sequentially emit light on a scan line basis (or a row-by-row basis). For example, after a scan operation for pixels PX coupled to a scan line is performed, an emission operation of the pixels PX coupled to the scan line may be performed while a scan operation for pixels PX coupled to the next scan line is performed. Accordingly, emission periods of the pixels PX may be different (e.g., may not at least partially overlap) according to the rows (or the scan lines) of the pixels PX.

Further, the power supply voltage ELVDD in the display panel 110 may be changed according to the load of the display panel 110. Thus, because pixels PX at different rows emit light during different emission periods, luminances of the pixels PX at the different rows may be different from each other in a case where the power supply voltage ELVDD is changed at the different emission periods. For example, in the display panel 110 driven in the progressive emission manner, the pixels PX at the different rows may have different luminances from each other because of the temporal variation (or variation over time) of the power supply voltage ELVDD. Because respective pixels PX have different luminances according to the rows at which the respective pixels PX are located, a horizontal band may appear at the display panel 110 even though the same data signal SDATA is applied to the respective pixels PX. This phenomenon may be intensified when the display panel 110 is driven by a digital driving method.

Figure 4:
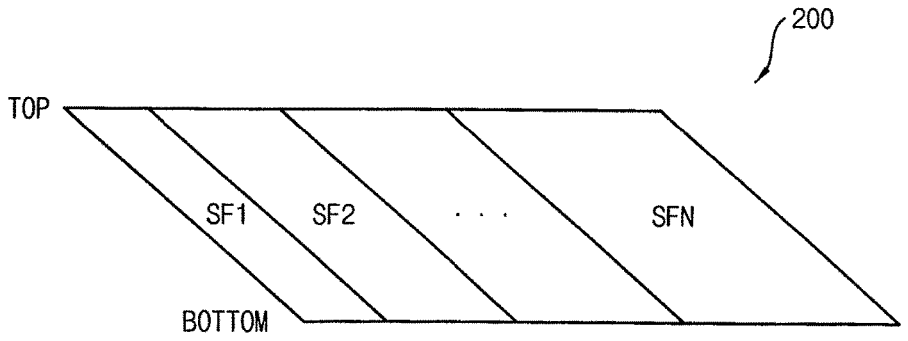
FIG. 4 illustrates a frame for one embodiment of a digital driving method.

Referring to FIG. 4, in one embodiment, one frame 200 may be divided into a plurality of sub-frames SF1, SF2 and SFN. Each pixel PX may selectively emit light at the respective sub-frames SF1, SF2 and SFN. Thus, the emission duty cycle of each pixel PX in one frame 200 may be adjusted to produce a grayscale value. Further, the pixels PX may sequentially emit light on a scan line basis (or the row-by-row basis). For example, the pixels PX may sequentially emit light from the pixels PX at the top portion TOP of the display panel 110 to the pixels PX at the bottom portion BOTTOM of the display panel 110.

In one embodiment, the display device 100 may be driven in a progressive emission with simultaneous scan (PESS) manner. For example, as illustrated in FIG. 6, a time period corresponding to one frame may be divided into a plurality of unit times UNIT1, UNIT2, UNIT3, UNIT4, UNIT5 and UNIT6. The number of the unit times UNIT1, UNIT2, UNIT3, UNIT4, UNIT5 and UNIT6 may correspond to a vertical resolution of the display panel 110 or the number of the scan lines (or the rows). Further, each unit time UNIT1, UNIT2, UNIT3, UNIT4, UNIT5 and UNIT6 may be divided into a plurality of partial times. The number of the partial times in each unit time UNIT1, UNIT2, UNIT3, UNIT4, UNIT5 and UNIT6 may correspond to the number of the sub-frames SF1, SF2 and SFN in one frame 200.

FIG. 5 illustrates an example where the display panel 110 includes six rows of the pixels PX, and one frame 200 includes four sub-frames SF1, SF2 and SFN. Thus, in FIG. 5, the time period corresponding to one frame is divided into six unit times UNIT1, UNIT2, UNIT3, UNIT4, UNIT5 and UNIT6, and each unit time UNIT1, UNIT2, UNIT3, UNIT4, UNIT5 and UNIT6 is divided into four partial times. At the respective partial times of each unit time UNIT1, UNIT2, UNIT3, UNIT4, UNIT5 and UNIT6, data corresponding to different sub-frames SF1, SF2 and SFN may be written to different pixel rows. Further, the data corresponding to one sub-frame may be sequentially written to a plurality of pixel rows with an interval of one unit time.

Thus, in the PESS manner, respective scan times for the plurality of pixel rows may be uniformly (or evenly) distributed within the entire time period corresponding to one frame. As a result, a sufficient data writing time may be obtained for each scan operation. The PESS manner may be suitable, for example, for a large-sized display device having a high resolution. In the display device 100 driven by the digital driving method or the PESS manner, a horizontal band caused by temporal variation of the power supply voltage ELVDD may be intensified.

Figure 6A:
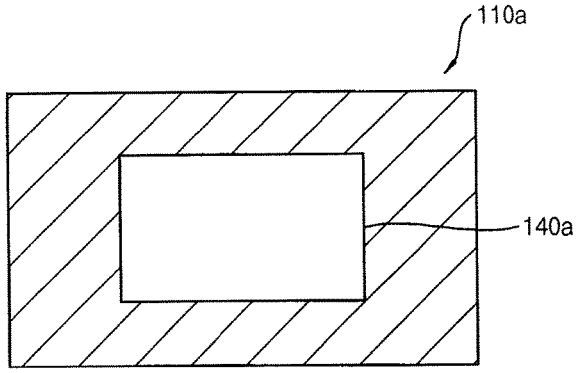
FIG. 6A illustrates an example of box pattern.
Figure 6B:
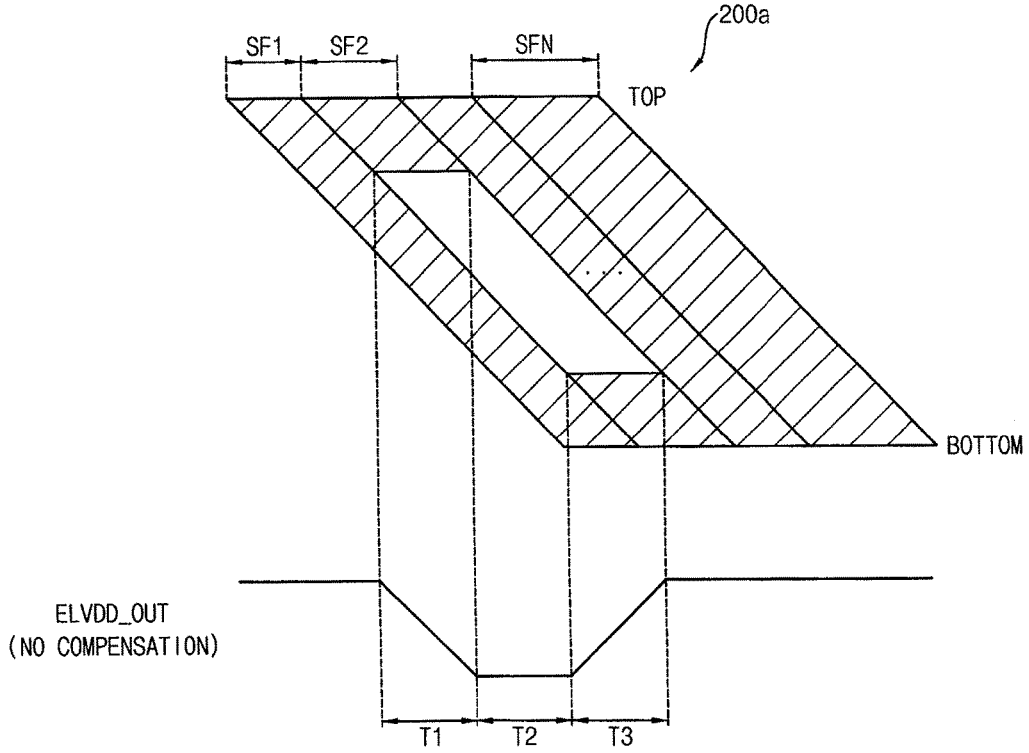
FIG. 6B illustrates an example of temporal variation of a power supply voltage for the box pattern.

For example, in a case where a display panel 110*a* displays a box pattern 140*a* having a predetermined grayscale value as illustrated in FIG. 6A, the amount of voltage drop of a power supply voltage ELVDD may vary over time within one frame 200*a* or within one sub-frame SF2 as illustrated in FIG. 6B. Thus, the dropped power supply voltage ELVDD_OUT may vary over time.

For example, during a first time period T1, the amount of the voltage drop may increase as a load of the display panel 110*a* increases, and a voltage level of the power supply voltage ELVDD_OUT may decrease over time.

During a second time period T2, the power supply voltage ELVDD_OUT may maintain the decreased voltage level.

During a third time period T3, the amount of the voltage drop may decrease as the load of the display panel 110*a* decreases, and the voltage level of the power supply voltage ELVDD_OUT may increase over time.

In the display device 100 driven by the digital driving method or the PESS manner, because the emission periods of the pixels PX may be different according to the rows of the pixels PX, luminances of the pixels PX may be changed according to the rows of the pixels PX because of this temporal variation of the power supply voltage ELVDD_OUT. For example, a pixel PX that emits light during the second time period T2 may have a luminance lower than a luminance of a pixel PX that emits light during the first time period T1. As described above, in the display device 100 driven with the digital driving method or the PESS manner, the power supply voltage ELVDD_OUT may vary over time within one frame 200*a* or within one sub-frame SF2. Thus, the pixels PX at different rows may have different luminances.

However, in the display device 100 according to one embodiment, the dropped power supply voltage ELVDD_OUT may be fed back to the power supply device 150. The power supply device 150 may then adjust the voltage level of the power supply voltage ELVDD_IN applied to the display panel 110 based on the dropped power supply voltage ELVDD_OUT. Accordingly, temporal variation of the power supply voltage ELVDD within each frame or within each sub-frame may be compensated.

Figure 6C:
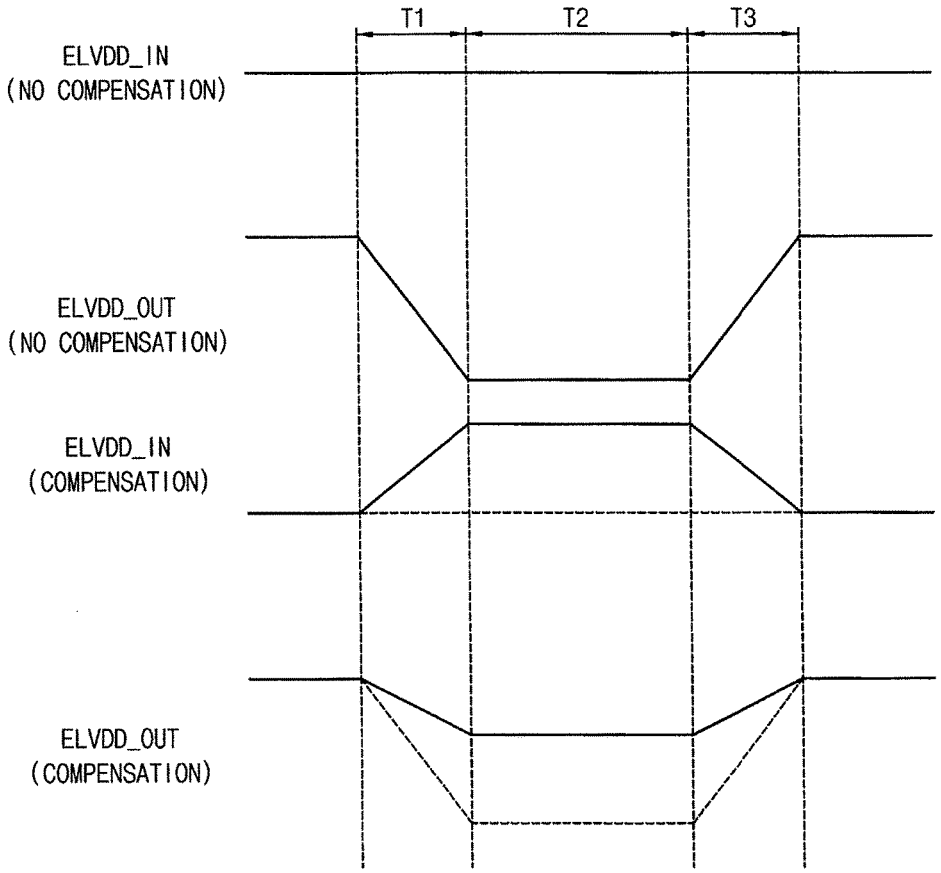
FIG. 6C illustrates an embodiment for compensating the temporal variation of the power supply voltage.

For example, as illustrated in FIG. 6C, the power supply device 150 may increase the power supply voltage ELVDD_IN applied to the display panel 110 during the first time period T1, during which the power supply voltage ELVDD_OUT received from the output power supply line 130 decreases. Further, the power supply device 150 may decrease the power supply voltage ELVDD_IN applied to the display panel 110 during the third time period T3, during which the power supply voltage ELVDD_OUT received from the output power supply line 130 increases. Accordingly, an effective voltage drop at each time period T1, T2, and T3 may be reduced. As a result, the pixels PX at different rows may have substantially the same or similar luminances, even if the respective pixels PX emit light at different time periods T1, T2, and T3. e.g., where the respective pixels PX emit light with the same emission duty cycle to produce the same grayscale value.

As described above, in one embodiment of the display device 100, the power supply device 150 may receive the dropped power supply voltage ELVDD_OUT from the output power supply line 130 of the display panel 110, and may compensate (e.g., in real time) the temporal variation of the power supply voltage ELVDD based on the dropped power supply voltage ELVDD_OUT. Thus, the pixels PX at different rows may have similar luminances, even if the pixels PX emit light at different time periods. As a result, a horizontal band may not appear at the display panel 110.

Figure 7:
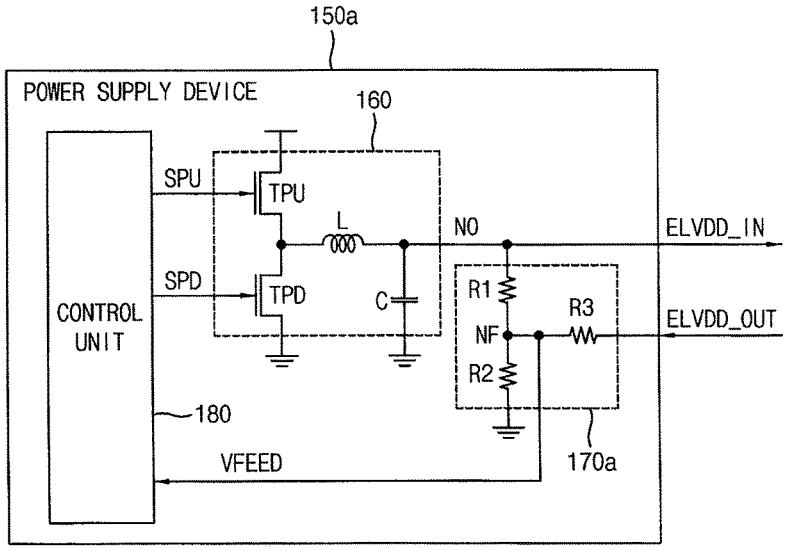
FIG. 7 illustrates an embodiment of a power supply device.

FIG. 7 illustrates an embodiment of a power supply device 150*a*, which, for example, may be included in a display device of FIG. 1. Referring to FIG. 7, the power supply device 150*a* includes a power supply voltage generating unit 160, a feedback unit 170*a*, and a control unit 180. The power supply voltage generating unit 160 generates a power supply voltage ELVDD_IN in response to switching signals SPU and SPD. The feedback unit 170*a* generates a feedback voltage VFEED based on the power supply voltage ELVDD_OUT received from an output power supply line of a display panel. The control unit 180 generates the switching signals SPU and SPD for the power supply voltage generating unit 160. The duty cycles of the switching signals SPU and SPD are adjusted based on the feedback voltage VFEED.

More specifically, the power supply voltage generating unit 160 may receive a pull-up switching signal SPU and a pull-down switching signal SPD as the switching signals SPU and SPD from the control unit 180. The power supply voltage generating unit 160 generates the power supply voltage ELVDD_IN in response to the pull-up switching signal SPU and the pull-down switching signal SPD. For example, the power supply voltage generating unit 160 may include a pull-up transistor TPU, a pull-down transistor TPD, an inductor L, and a capacitor C. The pull-up transistor TPU is selectively turned on in response to the pull-up switching signal SPU. The pull-down transistor TPD is selectively turned on in response to the pull-down switching signal SPD. The inductor L has a terminal coupled to the pull-up transistor TPU and the pull-down transistor TPD and another terminal coupled to an output node NO of the power supply device 150*a*. The capacitor C has a terminal coupled to the output node NO of the power supply device 150*a* and another terminal coupled to a ground voltage.

A voltage level of the power supply voltage ELVDD_IN may be increased by sourcing a current to the inductor L and the capacitor C while the pull-up transistor TPU is turned on. The voltage level of the power supply voltage ELVDD_IN may be decreased by sinking a current from the inductor L and the capacitor C while the pull-down transistor TPD is turned on. The voltage level of the power supply voltage ELVDD_ IN may be maintained as a desired voltage level by this increase and/or decrease of the voltage level of the power supply voltage ELVDD_IN.

The feedback unit 170*a* may include a first resistor R1 coupled between the output node NO and a feedback node NF, a second resistor R2 coupled between the feedback node NF and the ground voltage, and a third resistor R3 coupled between the feedback node NF and the output power supply line. The feedback voltage VFEED at the feedback node NF may be determined by the following equation: VFEED*(1/R1+1/R2+1/R3)=ELVDD_IN/R1+ELVDD_OUT/R3. Thus, the feedback voltage VFEED may increase as the power supply voltage ELVDD_OUT received from the output power supply line increases, and may decrease as the power supply voltage ELVDD_OUT received from the output power supply line decreases.

The control unit 180 may adjust the duty cycle of the pull-up switching signal SPU and/or the pull-down switching signal SPD based on the feedback voltage VFEED received from the feedback unit 170*a*. Accordingly, the voltage level of the power supply voltage ELVDD_IN generated by the power supply voltage generating unit 160 may be adjusted. For example, the control unit 180 may adjust the duty cycle of the pull-up switching signal SPU and/or the pull-down switching signal SPD such that the voltage level of the power supply voltage ELVDD_IN increases as the feedback voltage VFEED decreases and the voltage level of the power supply voltage ELVDD_IN decreases as the feedback voltage VFEED increases.

As described above, the power supply device 150*a* may adjust the voltage level of the power supply voltage ELVDD_IN applied to an input power supply line of the display panel according to the power supply voltage ELVDD_OUT received from the output power supply line. As a result, temporal variation of the power supply voltage may be compensated and luminance uniformity of the display panel may be improved.

Figure 8:
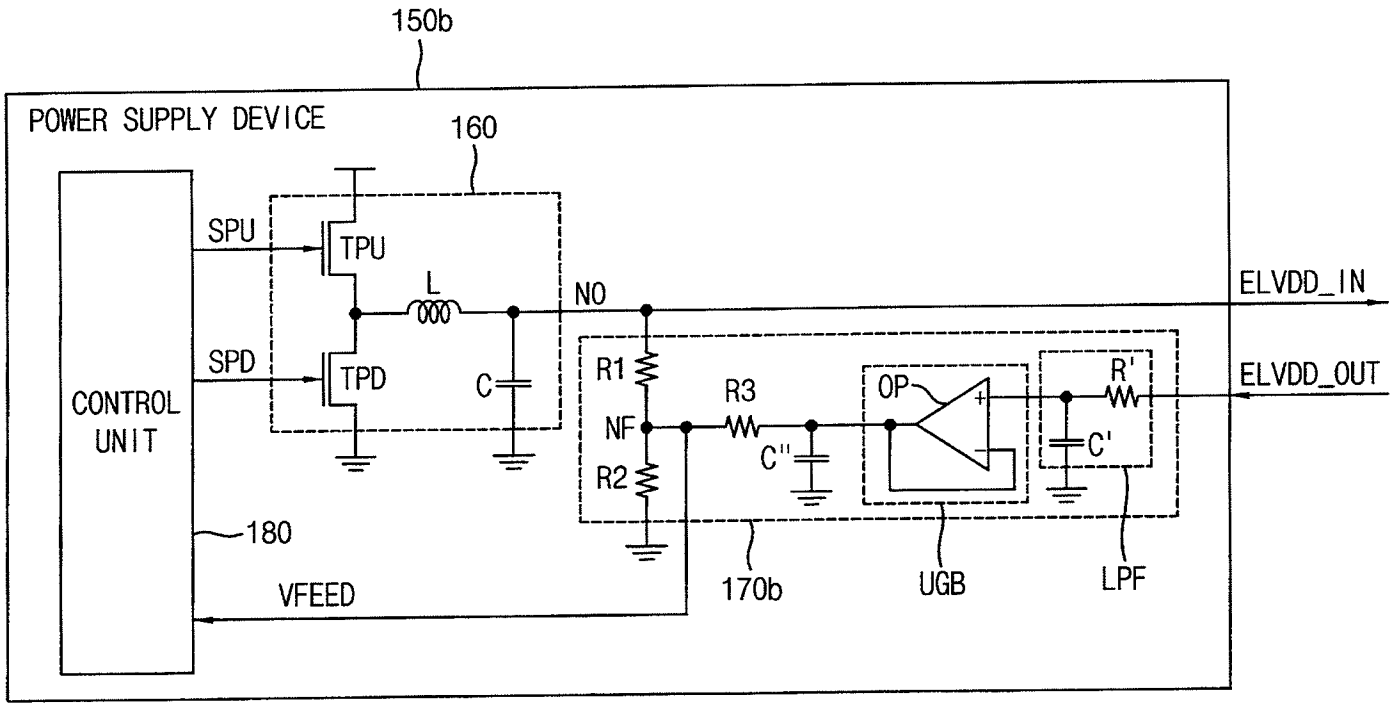
FIG. 8 illustrates another embodiment of a power supply device.

FIG. 8 illustrates another embodiment of a power supply device 150*b*, which, for example, may be included in the display device of FIG. 1. Referring to FIG. 8, a power supply device 150*b* may include a power supply voltage generating unit 160, a feedback unit 170*b*, and a control unit 180. The power supply voltage generating unit 160 generates a power supply voltage ELVDD_IN in response to switching signals SPU and SPD. The feedback unit 170*b* generates a feedback voltage VFEED based on the power supply voltage ELVDD_OUT received from an output power supply line of a display panel. The control unit 180 generates the switching signals SPU and SPD for the power supply voltage generating unit 160 and adjusts the duty cycle of the switching signals SPU and SPD based on the feedback voltage VFEED. The power supply device 150*b* of FIG. 8 may have a similar configuration to a power supply device 150*a* of FIG. 7, except for the configuration of the feedback unit 170*b*.

Compared with a feedback unit 170*a* in FIG. 7, the feedback unit 170*b* in FIG. 8 may further include a unit gain buffer UGB coupled between the output power supply line and a third resistor R3. The unit gain buffer UGB may allow the display panel not to be electrically affected by the feedback unit 170*b*. For example, the unit gain buffer UGB may include an operational amplifier OP having an inverted input terminal coupled to an output terminal of the operational amplifier OP.

In one embodiment, the feedback unit 170*b* may include a low pass filter LPF coupled between the output power supply line and the unit gain buffer UGB. The low pass filter LPF may eliminate or reduce a high frequency component of the power supply voltage ELVDD_OUT received from the output power supply line. For example, the pass filter LPF may be implemented with a resistor R' and a capacitor C'.

In one embodiment, the feedback unit 170*b* may further include a capacitor C" coupled to the output terminal of the unit gain buffer UGB to stabilize an output voltage (or the power supply voltage ELVDD_OUT) of the unit gain buffer UGB. For example, the capacitor C" may eliminate or reduce a glitch of the power supply voltage ELVDD_OUT output from the unit gain buffer UGB.

Figure 9:
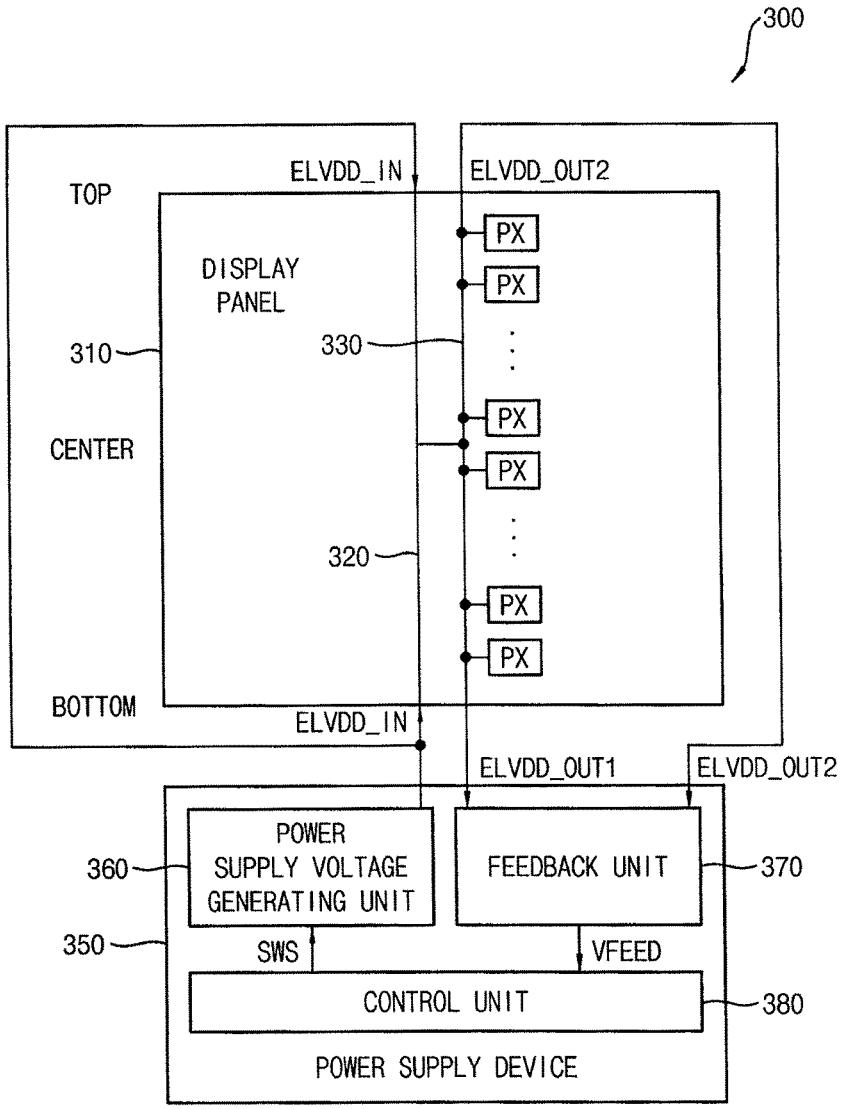
FIG. 9 illustrates another embodiment of a display device.
Figure 10:
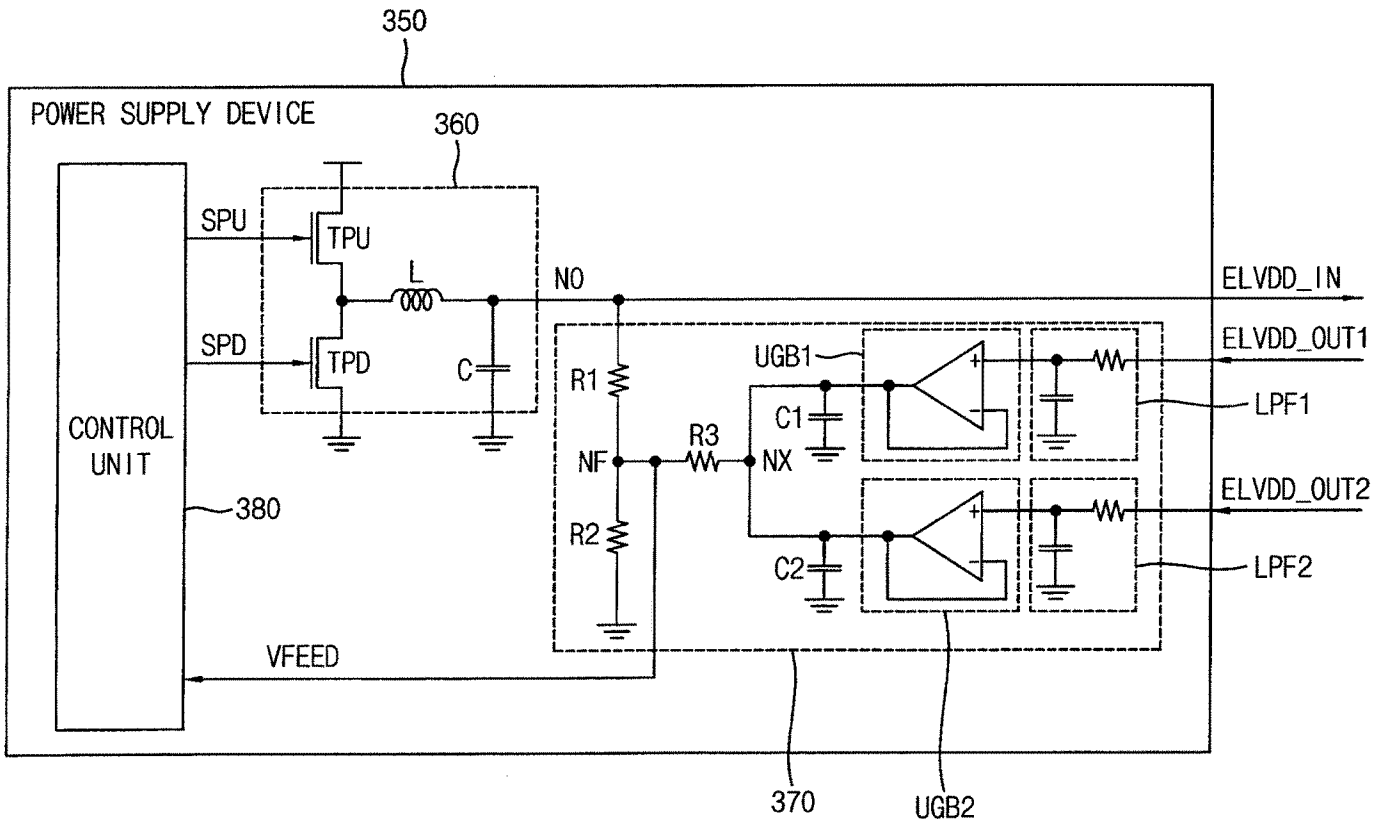
FIG. 10 illustrates another embodiment of a power supply device.

FIG. 9 illustrates another embodiment of a display device 300, and FIG. 10 illustrates another embodiment of a power supply device, which, for example, may be a power supply device 350 in the display device of FIG. 9.

Referring to FIG. 9, the display device 300 includes a display panel 310 including a plurality of pixels PX, and a power supply device 350 that supplies a power supply voltage ELVDD_IN to the display panel 310. The display device 300 may have a similar configuration to a display device 100 of FIG. 1, except that the power supply voltage ELVDD_IN is supplied at both edge portions TOP and BOTTOM of the display panel 110, and dropped power supply voltages ELVDD_OUT1 and ELVDD_OUT2 are output at the both edge portions TOP and BOTTOM of the display panel 110.

The power supply device 350 may apply the power supply voltage ELVDD_IN to an input power supply line 320 at one or more edge portions TOP and BOTTOM of the display panel 310. In one embodiment, the power supply device 350 may be coupled to a first end and a second end of the input power supply line 320 at a first edge portion (e.g., a bottom portion BOTTOM) and a second edge portion (e.g., a top portion TOP) of the display panel 310, to apply the power supply voltage ELVDD_IN to the input power supply line 320 at the first and second edge portions TOP and BOTTOM.

Further, the power supply device 350 may receive the power supply voltage ELVDD_OUT from an output power supply line 330 at one or more edge portions TOP and BOTTOM of the display panel 310. In one embodiment, the power supply device 350 may be coupled to a first end of the output power supply line 330 at the first edge portion (e.g., the bottom portion BOTTOM) of the display panel 310 to receive a first output power supply voltage ELVDD_OUT1 from the output power supply voltage 330 at the first edge portion BOTTOM.

The power supply device 350 may also be coupled to the a second end of the output power supply line 330 at the second edge portion (e.g., the top portion TOP) of the display panel 310 opposite to the first edge portion BOTTOM, to receive a second output power supply voltage ELVDD_OUT2 from the output power supply voltage 330 at the second edge portion TOP. The power supply device 350 may adjust a voltage level of the power supply voltage ELVDD_IN applied to the input power supply line 320 based on the first output power supply voltage ELVDD_OUT1 at the first edge portion BOTTOM and the second output power supply voltage ELVDD_OUT2 at the second edge portion TOP. Because the first and second output power supply voltages ELVDD_OUT1 and ELVDD_OUT2 at the first and second edge portions TOP and BOTTOM are fed back to the power supply device 350, a voltage drop of the power supply voltage may be efficiently compensated, and luminance uniformity of the display panel 310 may be improved.

The power supply device 350 may include a power supply voltage generating unit 360, a feedback unit 370, and a control unit 380. The power supply device 350 illustrated in FIG. 9 may have a similar configuration to a power supply device 150 illustrated in FIG. 1, except that the feedback unit 370 receives the first and second power supply voltages ELVDD_OUT1 and ELVDD_OUT2.

As illustrated in FIG. 10, the feedback unit 370 may include a first resistor R1, a second resistor R2, and a third resistor R3. The first resistor R1 is coupled between an output node NO of the power supply device 350 and a feedback node NF. The second resistor R2 is coupled between the feedback node NF and a ground voltage. The third resistor R3 has a terminal coupled to the feedback node NF and another terminal coupled to the first end of the output power supply line 330 and the second end of the output power supply line 330. The voltage at a node NX, coupled to the first and second ends of the output power supply line 330 and the another terminal of the third resistor R3, may have an average voltage level (or a middle voltage level) of the first and second output power supply voltages ELVDD_OUT1 and ELVDD_OUT2. A feedback voltage VFEED at the feedback node NF may be generated based on the voltage at the node NX having the average voltage level (or the middle voltage level) of the first and second output power supply voltages ELVDD_OUT1 and ELVDD_OUT2.

In one embodiment, the feedback unit 370 may include a first unit gain buffer UGB1 coupled between the first end of the output power supply line 330 and the third resistor R3, and a second unit gain buffer UGB2 coupled between the second end of the output power supply line 330 and the third resistor R3.

In one embodiment, the feedback unit 370 may include a first low pass filter LPF1 coupled between the first end of the output power supply line 330 and the first unit gain buffer UGB1, and a second low pass filter LPF2 coupled between the second end of the output power supply line 330 and the second unit gain buffer UGB2.

In one embodiment, the feedback unit 370 may include a first capacitor C1 coupled to an output terminal of the first unit gain buffer UGB1 to stabilize an output voltage of the first unit gain buffer UGB1, and a second capacitor C2 coupled to an output terminal of the second unit gain buffer UGB2 to stabilize an output voltage of the second unit gain buffer UGB2.

In the display device 300, the power supply device 350 may receive the dropped first and second output power supply voltages ELVDD_OUT1 and ELVDD_OUT2 from the output power supply line 330 of the display panel 310, and may compensate, in real time, temporal variation of the power supply voltage based on the dropped first and second output power supply voltages ELVDD_OUT1 and ELVDD_OUT2. Thus, the pixels PX at different rows may have similar luminances, even if the pixels PX emit light at different time periods. As a result, a horizontal band may not appear at the display panel 310.

Figure 11:
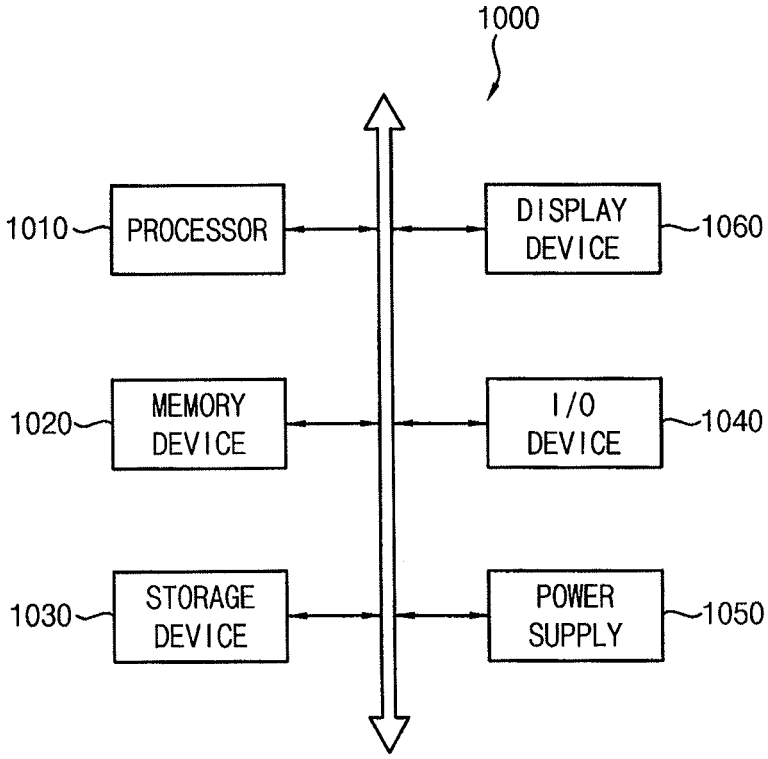
FIG. 11 illustrates an embodiment of an electronic device.

FIG. 11 illustrates an embodiment of an electronic device 1000 which includes a processor 1010, a memory device 1020, a storage device 1030, an input/output (I/O) device 1040, a power supply 1050, and an organic light emitting display device 1060. The electronic device 1000 may further include a plurality of ports for communicating a video card, a sound card, a memory card, a universal serial bus (USB) device, other electric devices, etc.

The processor 1010 may perform various computing functions. The processor 1010 may be, for example, a micro processor or a central processing unit (CPU). The processor 1010 may be coupled to other components via an address bus, a control bus, a data bus, etc. In one embodiment, the processor 1010 may be coupled to an extended bus such as a peripheral component interconnection (PCI) bus.

The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1030 may be a solid state drive device, a hard disk drive device, a CD-ROM device, etc. The I/O device 1040 may be an input device such as a keyboard, a keypad, a mouse, a touch screen, etc., and an output device such as a printer, a speaker, etc. The power supply 1050 may supply power for operations of the electronic device 1000.

The display device 1060 may compensate, in real time, a temporal variation of a power supply voltage by feeding back a dropped power supply voltage to a power supply device. Thus, pixels at different rows may have similar luminances, even if the pixels emit light at different time periods. As a result, a horizontal band may not appear at a display panel.

The electronic device 1000 may include the display device 1060 and, for example, may be a television, a computer monitor, a laptop, a digital camera, a cellular phone, a smart phone, a personal digital assistant (PDA), a portable multimedia player (PMP), a MP3 player, a navigation system, a video phone, etc. The display panel may be an organic light emitting display panel or another type of display panel.

By way of summation and review, in one type of digital driving type OLED display device (e.g., driven with the PESS method), an amount of a voltage drop of a power supply voltage may vary over time within one frame or within one sub-frame, and thus the dropped power supply voltage may vary over time. Accordingly, in this device, the power supply voltage may vary over time within one frame or within one sub-frame, and thus pixels at different rows may have different luminances.

In accordance with one or more of the aforementioned embodiments, a display device includes a power supply device to receive a dropped power supply voltage from an output power supply line of a display panel. Temporal variation of the power supply voltage is compensated, for example, in real time, within one frame or within one sub-frame based on the dropped power supply voltage. Thus, the pixels at different rows of the display panel may have the same or similar luminances, even if the pixels emit light at different time periods. As a result, a horizontal band may not appear at the display panel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a power supply configured to generate a power supply voltage; and a display panel including:

a plurality of pixels;

an input power supply line coupled to the power supply at one or more edge portions of the display panel, the input power supply line configured to receive the power supply voltage from the power supply; and an output power supply line coupled to the input power supply line at a predetermined portion of the display panel, the output power supply line configured to receive the power supply voltage from the input power supply line and further configured to input the power supply voltage to the pixels, wherein:

the predetermined portion is at a location different from an edge of the display panel, the power supply is coupled to the output power supply line at the one or more edge portions of the display panel, the power supply further configured to receive the power supply voltage from the output power supply line and further configured to adjust a voltage level of the power supply voltage applied to the input power supply line based on the power supply voltage from the output power supply line.

2. The display device as claimed in claim 1, wherein the predetermined portion is located substantially at a center of the display panel.

3. The display device as claimed in claim 1, wherein:

the display panel is driven in a progressive emission manner to cause the pixels to sequentially emit light on a scan line basis, and the power supply is further configured to adjust the voltage level of the power supply voltage applied to the input power supply line to compensate temporal variation of the power supply voltage.

4. The display device as claimed in claim 1, wherein:

the display panel is driven with a digital driving method by dividing each of a plurality of frames into a plurality of sub-frames, and the power supply is configured to adjust the voltage level of the power supply voltage applied to the input power supply line to compensate temporal variation of the power supply voltage within each sub-frame.

5. The display device as claimed in claim 1, wherein the power supply includes:

a power supply voltage generator configured to generate the power supply voltage based on at least one switching signal;

a feedback circuit coupled to the output power supply line at the one or more edge portions of the display panel, the feedback circuit configured to generate a feedback voltage based on the power supply voltage received from the output power supply line; and a controller configured to generate the at least one switching signals for input into the power supply voltage generator, and further configured to adjust a duty cycle of the at least one switching signal based on the feedback voltage.

6. The display device as claimed in claim 5, wherein:

the at least one switching signal includes a pull-up switching signal and a pull-down switching signal, and the power supply voltage generator includes:

a pull-up transistor configured to be selectively turned on based on the pull-up switching signal;

a pull-down transistor configured to be selectively turned on based on the pull-down switching signal;

an inductor having a terminal coupled to the pull-up transistor and the pull-down transistor and another terminal coupled to an output node of the power supply; and a capacitor having a terminal coupled to the output node of the power supply and another terminal coupled to a ground voltage.

7. The display device as claimed in claim 5, wherein the feedback circuit includes:

a first resistor coupled between an output node of the power supply and a feedback node;

a second resistor coupled between the feedback node and a reference voltage; and a third resistor coupled between the feedback node and the output power supply line.

8. The display device as claimed in claim 7, wherein the feedback circuit further includes a unit gain buffer coupled between the output power supply line and the third resistor.

9. The display device as claimed in claim 8, wherein the feedback circuit further includes a low pass filter coupled between the output power supply line and the unit gain buffer.

10. The display device as claimed in claim 8, wherein the feedback circuit further includes a capacitor coupled to an output terminal of the unit gain buffer to stabilize an output voltage of the unit gain buffer.

11. The display device as claimed in claim 5, wherein:

the feedback circuit is coupled to a first end of the output power supply line at a first edge portion of the display panel, the feedback circuit further configured to receive a first output power supply voltage from the output power supply voltage at the first edge portion, the feedback circuit is coupled to the a second end of the output power supply line at a second edge portion of the display panel opposite to the first edge portion, the feedback circuit further configured to receive a second output power supply voltage from the output power supply voltage at the second edge portion, and the feedback circuit is further configured to generate the feedback voltage based on the first output power supply voltage and the second output power supply voltage.

12. The display device as claimed in claim 11, wherein the feedback circuit includes:

a first resistor coupled between an output node of the power supply and a feedback node;

a second resistor coupled between the feedback node and a reference voltage; and a third resistor having a terminal coupled to the feedback node and another terminal coupled to the first end of the output power supply line and the second end of the output power supply line.

13. The display device as claimed in claim 12, wherein the feedback circuit further includes:

a first unit gain buffer coupled between the first end of the output power supply line and the third resistor; and a second unit gain buffer coupled between the second end of the output power supply line and the third resistor.

14. The display device as claimed in claim 13, wherein the feedback circuit further includes:

a first low pass filter coupled between the first end of the output power supply line and the first unit gain buffer; and a second low pass filter coupled between the second end of the output power supply line and the second unit gain buffer.

15. The display device as claimed in claim 13, wherein the feedback circuit further includes:

a first capacitor coupled to an output terminal of the first unit gain buffer to stabilize an output voltage of the first unit gain buffer; and a second capacitor coupled to an output terminal of the second unit gain buffer to stabilize an output voltage of the second unit gain buffer.

16. The display device as claimed in claim 11, wherein:

the power supply is coupled to a first end of the input power supply line at the first edge portion of the display panel, the power supply further configured to apply the power supply voltage to the input power supply voltage at the first edge portion, and the power supply is coupled to the a second end of the input power supply line at the second edge portion of the display panel, the power supply further configured to apply the power supply voltage to the input power supply voltage at the second edge portion.

17. A display device, comprising:

a power supply configured to generate a power supply voltage; and a display panel including:

a plurality of pixels;

an input power supply line coupled to the power supply at one or more edge portions of the display panel and configured to receive the power supply voltage from the power supply;

an output power supply line coupled to the input power supply line at a predetermined portion of the display panel and configured to receive the power supply voltage from the input power supply line, the output power supply line coupled to the pixels to provide the power supply voltage to the pixels, wherein the predetermined portion is at a location different from an edge of the display panel, and wherein the power supply includes:

a power supply voltage generator configured to generate the power supply voltage in response to at least one switching signal;

a feedback circuit coupled to the output power supply line at the one or more edge portions of the display panel, the feedback circuit configured to generate a feedback voltage based on the power supply voltage from the output power supply line; and a controller configured to generate the at least one switching signal and further configured to provide the at least one switching signal to the power supply voltage generator, the controller further configured to adjust a duty cycle of the at least one switching signal based on the feedback voltage to adjust a voltage level of the power supply voltage applied to the input power supply line.

18. The display device as claimed in claim 17, wherein the predetermined portion is located substantially at a center of the display panel.

19. The display device as claimed in claim 17, wherein:

the display panel is driven in a progressive emission manner to cause the pixels to sequentially emit light on a scan line basis, and the power supply is further configured to adjust the voltage level of the power supply voltage applied to the input power supply line to compensate temporal variation of the power supply voltage.

20. The display device as claimed in claim 17, wherein:

the display panel is driven in a digital driving method by dividing each of a plurality of frames into a plurality of sub-frames, and the power supply is further configured to adjust the voltage level of the power supply voltage applied to the input power supply line to compensate temporal variation of the power supply voltage within each sub-frame.

* * * * *